US007163725B2

(12) United States Patent
Johnson et al.

(10) Patent No.: US 7,163,725 B2
(45) **Date of Patent: *Jan. 16, 2007**

(54) DISPLAY TREE WITH BUBBLE TRUNK

(76) Inventors: R. James Johnson, 9868 Flint Dr., Sandy, UT (US) 84094; Robert M. Johnson, 1675 Hidden Valley Club Cir., Sandy, UT (US) 94092; Jonathan L. Johnson, 408 Sandy Woods La., Midvale, UT (US) 84047; Jayson A. Johnson, 4140 S. 2700 East, Salt Lake City, UT (US) 84124; Susan L. Johnson, 4083 Parkview Dr., Salt Lake City, UT (US) 84124; Ronald F. Johnson, 4083 Parkview Dr., Salt Lake City, UT (US) 84124

( * ) Notice: Subject to any disclaimer, the term of this patent is extended or adjusted under 35 U.S.C. 154(b) by 368 days.

This patent is subject to a terminal disclaimer.

(21) Appl. No.: 10/703,833

(22) Filed: Nov. 7, 2003

(65) Prior Publication Data

US 2004/0137172 A1 Jul. 15, 2004

Related U.S. Application Data

(63) Continuation-in-part of application No. 09/196,938, filed on Nov. 20, 1998, now Pat. No. 6,811,836.

(51) Int. Cl.
*A47G 33/06* (2006.01)
*A41G 1/00* (2006.01)

(52) U.S. Cl. ..... 428/20; 428/18; 362/101; 362/123; 362/96; 362/568; 40/406; 40/407; D11/118

(58) Field of Classification Search ..... 428/17, 428/18, 19, 27; D11/118, 119; 211/205; 362/101, 123, 96, 568; 40/406, 407
See application file for complete search history.

(56) References Cited

U.S. PATENT DOCUMENTS

| | | | | |
|---|---|---|---|---|
| 2,550,023 | A | | 4/1951 | Reilly |
| 3,706,149 | A | | 12/1972 | Oliveri |
| 3,995,151 | A | | 11/1976 | Nordeen |
| 4,020,337 | A | | 4/1977 | Chatten |
| D250,519 | S | * | 12/1978 | Hashimoto ..... D11/118 |
| 4,331,720 | A | | 5/1982 | Vin Dick |

(Continued)

*Primary Examiner*—Jennifer C. McNeil
*Assistant Examiner*—Aaron Austin
(74) *Attorney, Agent, or Firm*—Thorpe North and Western, LLP.

(57) ABSTRACT

A display representing a tree, such as a Christmas tree, has a trunk made of a hollow tube and held by a base in substantially vertical position. A liquid, such as water, is placed in the tube and an air supply in or near the bottom of the tube generates bubbles that rise through the tube. The tube and bubbles therein are preferably illuminated to add to the effectiveness of the display. Illumination can be provided by LED's which avoid the heat of incandescent lamps. Branches are secured to the trunk tube and extend outwardly therefrom to support a foliage garland to provide tree foliage and give the display the appearance of a tree. The tree can be provided as a separate trunk tube portion, base, and foliage garland so the parts can be packed and shipped without the base attached to the tube.

21 Claims, 3 Drawing Sheets

U.S. PATENT DOCUMENTS

Figure 1:
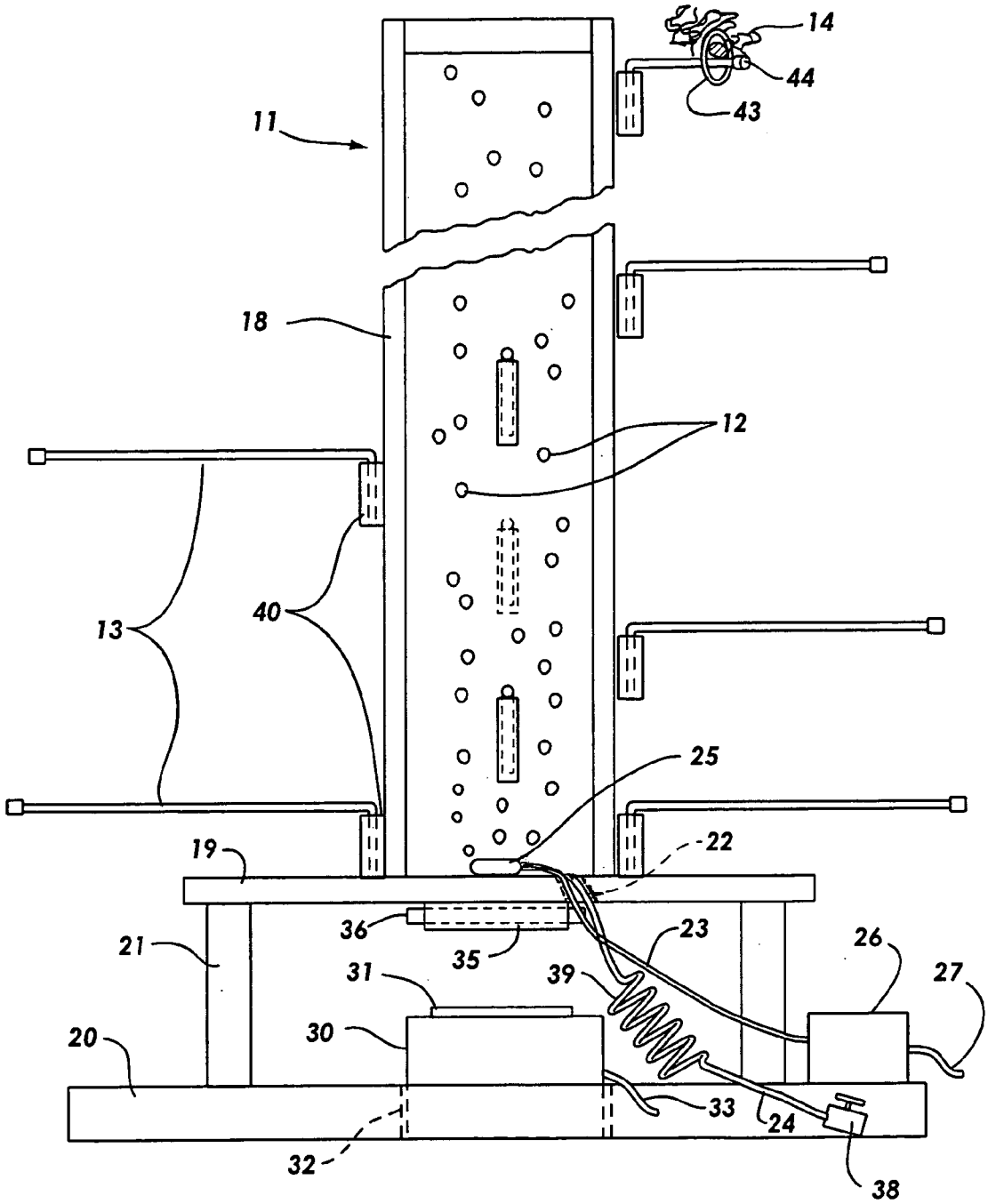

| | | | | | |
|---|---|---|---|---|---|
| D323,286 | S | * | 1/1992 | Roetting | D8/372 |
| 5,085,900 | A | * | 2/1992 | Hamlett | 428/18 |
| 5,104,608 | A | | 4/1992 | Pickering | |
| 5,349,771 | A | | 9/1994 | Burnett | |
| 5,363,577 | A | | 11/1994 | Fuller | |
| 5,420,765 | A | | 5/1995 | Nordeen | |
| D390,157 | S | * | 2/1998 | Burnett | D11/118 |
| 5,819,452 | A | | 10/1998 | Hakkert | |
| 5,939,154 | A | | 8/1999 | Gonzalez | |
| 6,048,590 | A | * | 4/2000 | Phillips | 428/9 |
| 6,099,920 | A | | 8/2000 | Kao | |
| 6,773,134 | B1 | * | 8/2004 | Harvey | 362/123 |
| 2004/0141319 | A1 | * | 7/2004 | Huang | 362/227 |

* cited by examiner

DISPLAY TREE WITH BUBBLE TRUNK

RELATED APPLICATIONS

This is a continuation-in-part of application Ser. No. 09/196,938, filed Nov. 20, 1998, now U.S. Pat. No. 6,811,836 and entitled "Display Tree With Bubble Trunk."

BACKGROUND OF THE INVENTION

1. Field

The invention is in the field of displays giving the appearance of or representing trees and particularly giving the appearance of a Christmas tree. Thus, the field includes the field of artificial Christmas trees.

2. State of the Art

There are many types of artificial Christmas trees currently available, some with built-in lights or light displays. There are also Christmas tree light sets and ornaments that generate bubbles in a tube full of fluid. Further, there are large displays that include bubble tubes and bubble walls where bubbles rise through fluid in such tubes and walls. However, applicants are not aware of any Christmas trees or other display trees which themselves incorporate a bubble display as part of the tree itself.

SUMMARY OF THE INVENTION

According to the invention, a tree display, such as an artificial Christmas tree although the tree display could be used for other occasions such as a Valentine tree, Easter tree, etc., has a trunk formed from a hollow tube configured to hold a liquid, such as water, therein. A base holds the tube in a substantially vertical position on a surface, such as a floor, table, or cabinet. An air supply means is located in the tube, preferably at or near the bottom of the tube, for supplying air to the tube to form bubbles in the liquid when in the tube. The air supply means can conveniently be an aquarium air supply which provides a stream of bubbles to the liquid. The air outlet of the air supply is located in the bottom of the tube with an air supply hose extending through the bottom of the tube to an air pump located outside the tube. It is also convenient to provide a drain hose extending through the bottom of the tube with the air supply hose. A drain valve in the drain hose selectively opens and closes the drain hose outside the tube so the tube can be conveniently drained when desired.

Preferably an illumination means, such as a light fixture or a plurality of light emitting diodes, is positioned in the base to shine light onto and into the bottom of the tube. Light can also be shined onto and into the top of the tube. The light can be colored in various ways to create a desired display effect.

A plurality of branch means are mounted on the hollow tube and extend outwardly from the tube to represent tree branches and/or as a support for foliage means which is supported by the branch means to give the display the appearance of a tree. The branch means may be lengths of substantially rigid rods each with a mounting end bent substantially perpendicular to a substantially rigid branch portion. The mounting ends are removably inserted into mounting sleeves secured around the hollow tube with similar orientation to the hollow tube. The rods extend outwardly from the hollow tube (tree trunk) in preferably a helical pattern with the upper rods being shorter than the lower rods to give a pine tree shape. With the substantially rigid rods, a Christmas tree can be formed by securing an artificial pine or spruce foliage garland to the ends of the rods so the garland begins at the top of the tree and spirals in helical fashion from the top of the tree around the hollow tube to the bottom of the tree with the tree getting wider top to bottom. The garland may be formed with ornaments and lights built into the garland.

With the above-described specific construction, the tree can be stored by removing the branches from the hollow tube trunk, starting at the bottom, and placing them in a helical mound or stack in a storage box or other container.

In a preferred embodiment, a hollow tube with sealed bottom is removably secured to the base so the tube and base may be separately packaged and transported.

THE DRAWINGS

Figure 4:
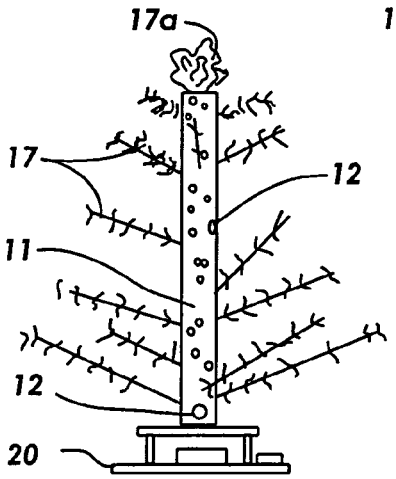
Figure 3:
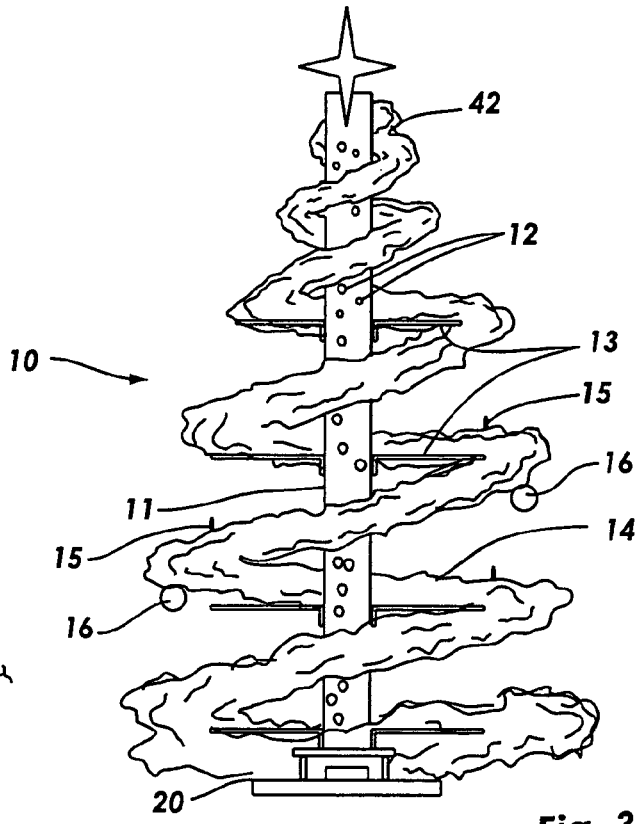
Figure 2:
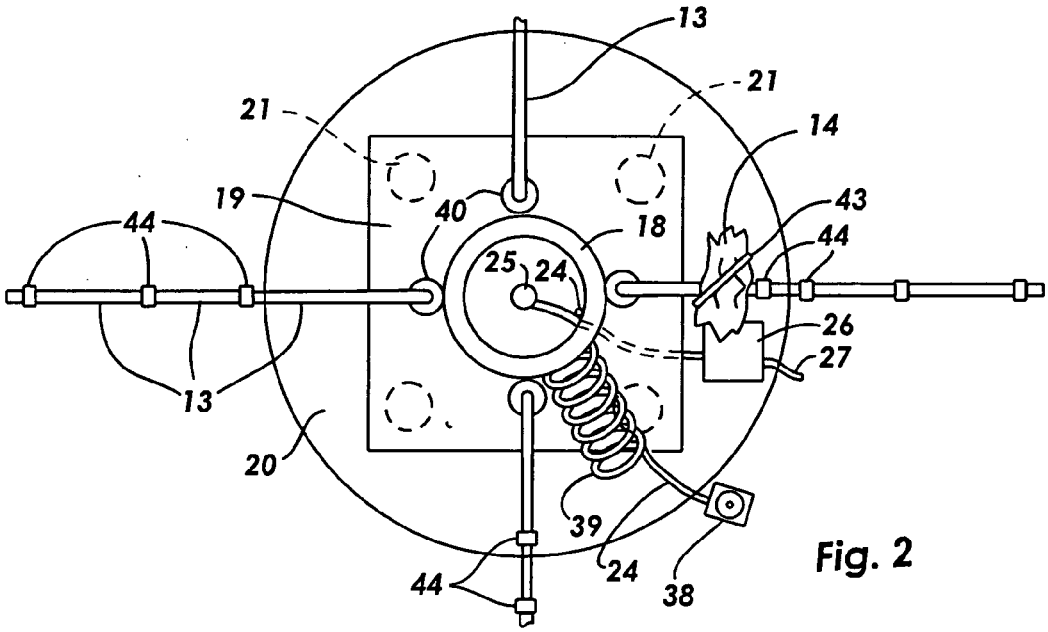
Figures 5, 6:
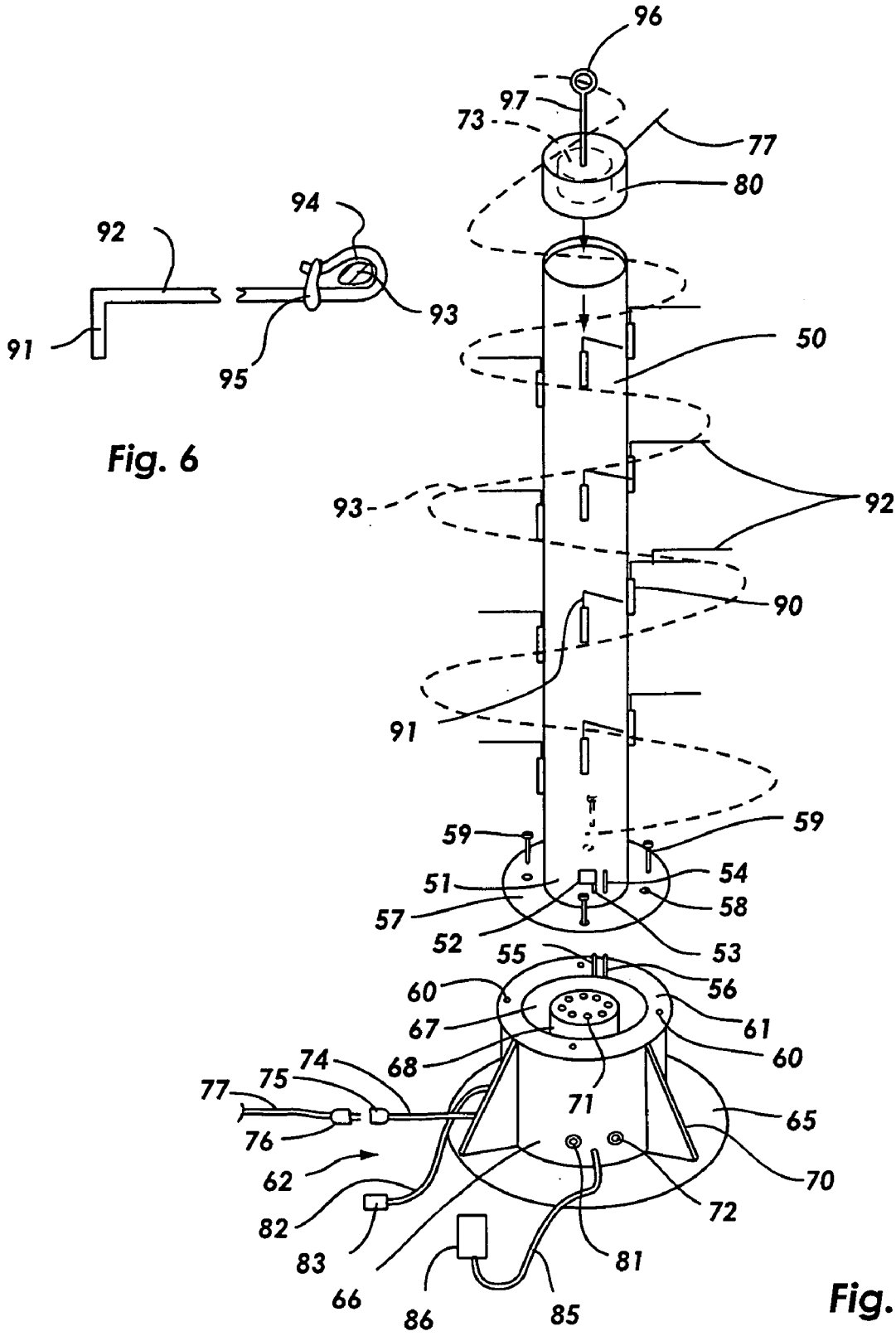

The best mode presently contemplated for carrying out the invention is illustrated in the accompanying drawings, in which:

FIG. 1 is a side elevation, with a portion broken away, of the base and trunk of a tree display of the invention;

FIG. 2, a top plan view of the tree display of FIG. 1 drawn to a smaller scale;

FIG. 3, a side elevation of a tree display of the invention;

FIG. 4, a side elevation of a different embodiment of a tree display of the invention;

FIG. 5, a perspective assembly view of a further embodiment of tree display of the invention; and FIG. 6, a side elevation of a garland support rod with garland schematically shown in section.

DETAILED DESCRIPTION OF THE ILLUSTRATED EMBODIMENT

The invention in one embodiment is a display 10, FIG. 3, representing a tree, such as a Christmas tree as shown, having a bubble trunk 11, i.e., a trunk which is substantially transparent and has bubbles 12 moving upwardly therein with the bubbles preferably illuminated. The tree can have various shapes and themes and be formed by branch means and foliage means in various ways. A Christmas tree as illustrated in FIG. 3 has branch means 13 extending from the trunk and supporting foliage means in the form of a garland 14. With a Christmas tree, the garland may be formed with Christmas tree lights 15 and ornaments 16 included as part of the garland. Of course, lights and ornaments may be added separately and the tree could have other than a Christmas theme, such as an Easter theme, with appropriate foliage and decorations for the theme involved.

A tree with branch means 17 that include the foliage is shown in FIG. 4. A top 17*a* is provided to finish the tree appearance, the tree trunk 11 with bubbles 12 and other parts of the tree are similar to those of FIG. 3.

In a presently preferred embodiment of the invention, the tree trunk 11 includes a hollow tube 18 secured to a base which includes upper base plate 19 and lower base plate 20, secured together by spacers 21. Upper base plate 19 seals the bottom of hollow tube 18 to make it fluid tight, and a hole 22 through upper base plate 19 allows an air supply hose 23 and a drain hose 24 to pass therethrough. Hole 22 around hoses 23 and 24 is sealed with a sealing material such as a silicone rubber. An air stone or other air spreading and bubble forming means 25, such as commonly used in aquariums, is located in hollow tube 18, preferably at the bottom of the tube, and is attached to air supply hose 23. The end of air supply hose 23 outside of tube 18 is coupled to a source of air 26 such as an electrically powered air pump, again as commonly used for aquariums. Electrical power is supplied to pump 26 by wire 27.

Air pump 26 pumps air through air supply hose 23 to air stone 25. When hollow tube 18 is filled with a liquid, such as water, the air leaving air stone 25 causes bubbles 12 to form and to rise in the liquid in tube 18. The top of tube 18 is open to the atmosphere.

It is preferred to illuminate hollow tube 18 and the bubbles rising therein to increase the pleasing visual effect of the bubbles rising in the tube. For that purpose, an illumination means such as a light fixture 30 with light bulb 31 is positioned in the base such as on or in lower base plate 20 so that light from bulb 31 is directed into and through hollow tube 18 to illuminate it. As shown, light fixture 30 may be positioned in an opening 32 in lower base plate 20, or, if no hole is provided in base plate 20, the fixture can merely rest on plate 20. Power to fixture 30 is provided through electrical cord 33.

In many cases it may be desired to color the light directed into hollow tube 18. Bulb 31 may be a colored bulb, or to make color changes easy, slide bracket 35 may be mounted on upper plate 19 immediately below tube 18 to removably receive a piece of colored or dyed plastic 36. Such piece 36 of colored plastic can be removed and replaced to provide different colors at different times. If desired, various other means of coloring or changing colors can be used. For example, where continuously changing colors are desired, a motorized color wheel can be located in the base so that changing color media is passed between bulb 31 and the bottom of tube 18 so that the light illuminating tube 18 is colored by the media of the color wheel.

It is convenient to provide a drain hose 24 with valve 38 at the end thereof outside of tube 18. Inside the tube, drain hose 24 ends in an open end substantially at the bottom of the tube. The tube can be of any desired length and coiled as at 39 so valve 38 can be moved to a liquid receptacle and opened when it is desired to drain liquid from tube 18. If drain hose 24 is not provided, it is merely necessary to lift and tip tube 18 with its base to pour liquid from the tube.

To complete the tree display, a plurality of branch means are provided extending outwardly from and around tube (trunk) 18. These branch means may take various forms such as artificial pine boughs or branches 17 as used in the usual artificial Christmas trees and as shown in FIG. 4, or may take the form of supports, such as rods 13, which extend from tube 18 to support foliage means such as the foliage garland 14. Rods 13 should be substantially rigid to the extent that they can adequately support garland 14, but may have some give or elasticity when hit or walked into. Rods of about three-sixteenths inch cold rolled steel have been found satisfactory. Such rods are formed with a substantially rigid portion extending from the tube 18 and a usually substantially perpendicular, relatively short mounting portion. Mounting tubes or sleeves 40 are secured to hollow tube 18 at spaced intervals around tube 18 to removably receive and hold the mounting portions of rods 13, as shown. In this way, rods 13 can rotate to some extent in mounting sleeves 40 if hit or walked into and can be removed for storage of the display tree. While various arrangements of branches 13 may be used, it is presently preferred that branches 13 be arranged in rings around tube 18 or, as shown, be arranged in helical fashion around tube 18. It is also preferred in order to provide the shape of a Christmas tree that the branches 13 get progressively larger from the top of the tube 18 (the top of the tree) to the bottom as indicated partially in FIGS. 1 and 2.

The foliage garland may be placed on top of tube 18, trunk 11 in FIG. 3, as at 42, FIG. 3, and may then be secured to branches 13 as it spirals from the top of the tree to the bottom thereof in ever widening manner. The garland may be secured to the ends of rods 13 by ties 43, FIGS. 1 and 2. When steel rods are used, it may be desirable to provide plastic caps 44, FIGS. 1 and 2, over the ends of rods 13.

The tube 18 (trunk 11) should be substantially transparent so that the bubbles in the tube can be seen through the walls of the tube. It has been found that tubes of transparent acrylic are satisfactory. Tubes with diameters of three to six inches work well with the larger diameter tubes being used with taller trees. For example, a six inch diameter tube can be used for a seven foot tall trunk tube 18, a five inch diameter tube for a five foot tall trunk tube, and a three inch diameter tube works well for a three foot tall trunk tube. Of course, these dimensions may vary as may the materials. It has also been found satisfactory to make the base of acrylic plates with spacers 21 being acrylic tubes. Mounting sleeves 40 may also be acrylic tubes, with tubes of about one-half inch outside diameter and about one-quarter inside diameter being satisfactory for use with the three-sixteenths inch branch rods 13. The sleeves 40 can be attached to the trunk tube 18 with glue such as a Weldon acrylic quick-drying glue.

The sleeves 40 can be placed at ninety degree intervals around trunk tube 18, as shown in FIGS. 1 and 2, or at various other intervals depending upon the foliage used, support needed, and appearance to be achieved.

It has been found that when using a foliage garland and removable branch rods, that the rods and attached garland can be easily removed from the trunk tube for storage of the display. Starting at the bottom of the tree, the branch rods and attached garland are removed and stacked in helical manner in a storage container until the top of the tree is reached and garland removed and placed on top of the stack. When reassembling the tree, the garland from the top of the stack is placed on top of the trunk tube and branches and garland added from top to bottom.

Various ways of mounting or securing the branch means to the trunk tube can be used other than the sleeves as described. For example, foliage branches 17 in FIG. 4 may be inserted into receiving sockets glued at angles to the trunk tube, or if a thick wall trunk tube is used, to receiving holes found in the trunk tube.

With the trunk of the tree filled with water as described, and aerated by the bubbles as described, it has been found that the trunk tube can function as an aquarium and for further interest in connection with the display, fish can be added to and live in the trunk tube.

It has been found that for packing and shipping purposes, the tree is best packed and shipped with the tree trunk and the base as separate pieces. A preferred embodiment of tree that allows such separate packing is shown in FIG. 5. The tree trunk tube 50, such as an acrylic tube, is sealed at the bottom with an acrylic disc 51. An air spreading and bubble forming device 52, such as an air stone, is substantially centered on bottom disc 51 inside the tube and an air connection nozzle 53 and drain connection nozzle 54 extend through the bottom disc to receive the open end of an air supply tube 55 and drain tube 56, respectively, thereover. A connection ring 57 extends beyond the perimeter of the trunk tube 50 and has holes 58 therethrough to receive screws 59 which are threaded into receiving holes 60 on base mounting ring 61 in order to secure the trunk tube 50 to base 62. Base 62 includes bottom plate 65 which rests on a support surface such as a floor or table to support and hold the tree in upright position, and base tube 66 which extends from base plate 65 to support base mounting ring 61, and which forms a compartment 67 to house the air pump, not shown, the lower light set 68, and the circuitry to control the lights, not shown. The air pump and light control circuitry is not visible because it is located in the bottom portion of compartment 67 so is hidden in FIG. 5 by base tube 66. Braces 70 add strength to the base.

The lower light set 68 is preferably a set of light emitting diodes, LED's, 71, arranged to shine light upwardly through the bottom disc 51 into the trunk tube 50. Eight LED's 71 are shown, but the number can vary. In an embodiment with changing colors, five white, five blue, five red, and five green LED's are spaced around the light set and light control circuitry controls illumination of the LED's in a desired pattern. The illumination ("on" or "off") and illumination pattern can be selected by the user through control knob 72. For example, the user may be able to choose between a constant selected color or continuously changing colors where the colors may change, for example, every ten seconds. Circuitry for controlling lights in this manner is well known so is not explained in detail here. The use of LED's as a light source is now preferred because LED's do not generate heat as do incandescent light sources. Further, the LED's are available to generate light in different colors and circuitry for controlling the LED's is known. However, the light generated by the LED's is still not as bright as can be generated by incandescent lamps so several LED's are illuminated at one time. Because of this, if the tree trunk is about five feet in height or over, it is preferred to provide an upper light set 72 73 of LED's similar to the lower light set of LED's 68. A wire 74 with female plug 75 will connect to a male plug 76 on wire 77 when the tree is assembled to connect the upper light set 72 73 with the light control circuitry in the base. The upper light set 73 will be secured in tube top cap 80 arranged to shine downwardly into the tube when the top cap 80 is positioned over the top of trunk tube 50. This provides illumination from both the bottom of the tube and the top of the tube. The base also includes an air "on" "off" switch 81, and has a drain tube 82 with drain control valve 83 extending therefrom for use in draining water from the tube, and a power cord 85 with wall transformer 86 adapted to plug into a standard 110 Volt AC wall receptacle. This means that only low voltage power is connected to the base.

As previously described, trunk tube 50 includes a plurality of mounting sleeves 90, similar to mounting sleeves 40, FIGS. 1 and 2, at spaced intervals around trunk tube 50 to removably receive and hold the mounting portion 91, FIGS. 5 and 6, of rods 92, similar to rods 13 of FIGS. 1 and 2, which form the supporting branches for foliage garland 93. As for the previously described garlands, foliage garland 93 provides the foliage for the tree and includes lights and ornaments therein. In addition, garland 93 includes wire 77 extending from connection with plug 75 to the upper light set 73. Rods 92 include end loop or hook portions 94 which receive intermediate portions of foliage garland 93. Preferably, a clip or tie 95 closes hook portion 94 to ensure that garland 93 remains in hook portion 94 particularly during assembly and disassembly of the tree. The top of garland 93 is held in eye 96 of top rod 97 secured to and extending from top cap 80. Generally, top cap 80 with upper light set 72 will remain as part of garland 93 for storage and transportation and will be placed over the top of tube 50 when the tree is assembled. Thus, the garland can be supplied with the rods 92 attached thereto and with top cap 80 attached thereto and the user assembles the trunk tube to the base and then attaches the garland to the trunk tube by inserting mounting portions 91 of rods 92 into mounting sleeves 90 and places top cap 80 over the top of trunk tube 50. The plug 76 at the end of wire 77 is plugged into plug 75 to connect the upper light set to the light control circuitry. The normal Christmas lights in garland 93 are separately plugged in and controlled in conventional manner.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

The invention claimed is:

1. An artificial Christmas tree having a bubbling trunk, comprising:

a hollow tube representing the trunk of the tree, said hollow tube configured to hold a liquid therein;

a base for holding the hollow tube in a substantially vertical position on a surface so that the hollow tube has a height with a top and bottom;

an air supply means located in the hollow tube for supplying air to the hollow tube to form bubbles in a liquid held by the hollow tube;

a plurality of rods mounted on the hollow tube and extending outwardly therefrom at selected locations along the height of the hollow tube, said rods near the top of the hollow tube being shorter than the rods near the bottom of the tube, and said rods being devoid of foliage; and a garland representing the only foliage for the tree secured to a selected plurality of rods to extend from rod to rod of the selected plurality of rods and between such rods and around the hollow tube in a helical fashion in a manner to give the appearance of a Christmas tree.

2. An artificial Christmas tree according to claim 1, wherein the garland, in combination with the rods, leaves portions of the hollow tube visible through the garland and rods.

3. An artificial Christmas tree according to claim 2, wherein the garland includes Christmas tree lights.

4. An artificial Christmas tree according to claim 3, wherein the rods are arranged in helical configuration around the hollow tube.

5. An artificial Christmas tree according to claim 1, additionally including a plurality of light emitting diodes mounted in cooperation with the base to illuminate the hollow tube.

6. An artificial Christmas tree according to claim 5, wherein the plurality of light emitting diodes include pluralities of light emitting diodes of different colors.

7. An artificial Christmas tree according to claim 1, additionally including a plurality of light emitting diodes mounted in cooperation with the top of the tube to illuminate the hollow tube.

8. An artificial Christmas tree according to claim 1, wherein the hollow tube includes a sealed bottom and is removably secured to the base so the hollow tube and base may be separated for packaging and transport.

9. A display representing a tree and having a bubble trunk, comprising:

a hollow tube representing the trunk of the tree, said hollow tube configured to hold a liquid therein;

a base for holding the hollow tube in a substantially vertical position on a surface so that the tube has a height;

an air supply means located in the hollow tube for supplying air to the hollow tube;

a plurality of light emitting diodes mounted in cooperation with the base to illuminate the hollow tube;

a plurality of rods mounted on the tube and extending outwardly therefrom spaced along substantially the entire height of the tube to represent tree branches; and a garland representing foliage secured to a selected plurality of rods to extend from rod to rod of the selected plurality of rods and between such rods in a manner to give the appearance of a tree having foliage.

10. A display representing a tree according to claim 9, wherein the plurality of light emitting diodes include pluralities of light emitting diodes of different colors.

11. A display representing a tree according to claim 10, wherein the tube has a top end, and additionally including a plurality of light emitting diodes mounted in cooperation with the top end of the tube to illuminate the hollow tube.

12. A display representing a tree and having a bubble trunk, comprising:

a hollow tube representing the trunk of the tree and having a closed bottom end and an open top end, said hollow tube configured to hold a liquid therein;

a base for holding the hollow tube in a substantially vertical position on a surface so that the hollow tube has a height, said hollow tube being removably secured to the base;

an air supply means located in the hollow tube for supplying air to the hollow tube;

a plurality of rods mounted on the hollow tube and extending outwardly therefrom spaced along substantially the entire height of the tube to represent tree branches; and a garland representing foliage secured to a selected plurality of rods to extend from rod to rod of the selected plurality of rods and between such rods in a manner to give the appearance of a tree having foliage.

13. A display representing a tree according to claim 12, additionally including illumination means mounted in cooperation with the base to illuminate the hollow tube.

14. A display representing a tree according to claim 13, wherein the illumination means mounted in cooperation with the base is a plurality of light emitting diodes.

15. A display representing a tree according to claim 14, wherein the plurality of light emitting diodes mounted in cooperation with the base include pluralities of light emitting diodes of different colors.

16. A display representing a tree according to claim 15, additionally including illumination means mounted in cooperation with the top end of the tube to illuminate the hollow tube.

17. A display representing a tree according to claim 16, wherein the illumination means mounted in cooperation with the top end of the tube is a plurality of light emitting diodes.

18. A display representing a tree according to claim 17, wherein the plurality of light emitting diodes mounted in cooperation with the top end of the tube include pluralities of light emitting diodes of different colors.

19. A display representing a tree according to claim 12, additionally including illumination means mounted in cooperation with the top end of the tube to illuminate the hollow tube.

20. A display representing a tree according to claim 19, wherein the illumination means mounted in cooperation with the top end of the tube is a plurality of light emitting diodes.

21. A display representing a tree according to claim 20, wherein the plurality of light emitting diodes mounted in cooperation with the top end of the tube include pluralities of light emitting diodes of different colors.

* * * * *